US006799405B2

(12) United States Patent
Gilbert

(10) Patent No.: US 6,799,405 B2
(45) Date of Patent: Oct. 5, 2004

(54) MASONRY UNIT AND MASONRY SYSTEM, AND METHOD OF USE

(76) Inventor: Del R. Gilbert, 61 Chapin Ter., Laconia, NH (US) 03246

( * ) Notice: Subject to any disclaimer, the term of this patent is extended or adjusted under 35 U.S.C. 154(b) by 0 days.

(21) Appl. No.: 10/337,528

(22) Filed: Jan. 6, 2003

(65) Prior Publication Data

US 2004/0128936 A1 Jul. 8, 2004

(51) Int. Cl.[7] ..... E04B 5/04

(52) U.S. Cl. ..... 52/604; 52/606; 52/610; 52/592.6; 52/612

(58) Field of Search ..... 52/604, 606, 610, 52/592.6, 745.09, 744.13, 745.1; 405/285, 284, 286

(56) References Cited

U.S. PATENT DOCUMENTS 3,922,832 A * 12/1975 Dicker ..... 52/741.15
5,410,848 A * 5/1995 McClinton et al. ..... 52/284
5,484,236 A * 1/1996 Gravier ..... 405/286
5,685,119 A * 11/1997 Zschoppe ..... 52/592.5
5,960,604 A * 10/1999 Blanton ..... 52/604
6,035,599 A * 3/2000 Sonnentag ..... 52/604
6,088,987 A * 7/2000 Simmons et al. ..... 52/592.6
6,152,655 A * 11/2000 Hull ..... 405/286
RE37,981 E * 2/2003 Layne ..... 52/36.4
6,609,340 B2 * 8/2003 Moore et al. ..... 52/309.11
6,665,994 B1 * 12/2003 Ruggeri ..... 52/592.6

* cited by examiner

*Primary Examiner*—Peter M. Cuomo
*Assistant Examiner*—Erika Garrett
(74) *Attorney, Agent, or Firm*—Michael J. Persson; Lawson & Persson, P.C.

(57) ABSTRACT

The present invention is a masonry unit, masonry system and method of constructing a structure using the system. In its most basic form, the masonry unit of the present invention includes substantially parallel top and bottom surfaces, substantially parallel a front and back surfaces, and substantially parallel right and left surfaces. A locking ridge is disposed upon the top surface and extends along the top surface in substantially parallel relation to the front and back surfaces. A locking channel is disposed with in the bottom surface and is dimensioned to mate with locking ridge on the top surface of an adjoining masonry unit. The locking channel is disposed inward from the bottom surface a distance that is a slightly larger than the distance from the top surface to the top of the ridge. The system includes a primary masonry unit and at least one corner masonry unit.

15 Claims, 8 Drawing Sheets

MASONRY UNIT AND MASONRY SYSTEM, AND METHOD OF USE

FIELD OF THE INVENTION

The present invention relates to the field of masonry units and, in particular, to masonry units for use in constructing dry stacked masonry walls and structures, and to methods of construction using such units.

BACKGROUND OF THE INVENTION

Masonry construction of structures offers many advantages over traditional wood framing, including increased strength, fire resistance and insulation value. Traditionally, masonry construction techniques involved taking masonry units, typically manufactured cement, sand, water & aggregate, "buttering" the units with mortar, typically mixed from cement, sand water and lime, and stacking the buttered units to form a number of courses. However, this technique has a number of disadvantages. First, the weakest part of such a masonry wall is the mortar joint, as the substitution of lime for aggregate reduces the overall strength of the joint. Second, the need to butter and precisely fit each block necessitates the use of skilled, and typically highly paid, masons. Finally, the mortar used to butter the units often hardens on the inside of openings within the blocks, preventing or hindering the insertion of insulation and/or reinforcements within the openings.

One solution to the lack of strength of mortar joints has been to dry stack the masonry units. In a typical dry stacked wall, the masonry units are stacked in a staggered arrangement and are reinforced by inserting steel rebar through interlocking holes. Once reinforced, a skin made up of a fiberglass and a cementicious material may be applied to the front and back faces of the walls to provide additional reinforcement. Adding the skin to the front and back faces of the wall increases the stability of the wall by up to ten times the stability of a wall without such a skin and provides an additional barrier to prevent cold and warm air from passing through the joints between masonry units. Therefore, the use of such a skin is preferred in these types of walls.

However, dry stacking of walls is not without drawbacks. First, like the staking of mortar walls, care must be taken to insure that the units are properly aligned with one another. This can be a painstaking process that greatly increases the time required to build such a wall. Second, the lack of motor in the joints between units allows air to easily pass through the joints and requires that a skin or other air barrier be used in connection with the walls. Third, the lack of mortar to hold the units in horizontal alignment make the use of many additional reinforcements, such as steel rebar, stabilizers, or the like, absolutely necessary in these types of walls.

A number of masonry units for dry stacked masonry retaining walls, such as those used for landscaping, erosion prevention, or the like, have been developed. Each of these systems utilizes a tab that extends downward from each unit and engages with the back side of the unit disposed below, causing the wall to be slightly angled backward toward the earth being retained. These masonry units work well in these applications, as the force of the earth upon the blocks counterbalances the backward lean of the wall, and the backward lean provides additional stability that could not be obtained in a straight wall without the use of "dead men" or other reinforcements. However, these units are not readily adapted for use in non-retaining walls, such as those used in structures, as the backward lean of produced by the stacking of the units makes these structures inherently unstable when they are not counterbalanced by the earth.

Therefore, there is a need for a masonry unit and masonry system that allow structures to be dry stacked without mortar, that allows masonry units to be quickly and accurately aligned during stacking, that does not require the use of separate stabilizers or other means for preventing deflection of the structure formed thereby, that produces substantially straight and stable walls, that retards the flow of air from one face of the wall to the other, that may be manufactured of a mixture of concrete and lightweight aggregate, and that will readily accept plaster or mesh substrates upon its outside surfaces without the need for sanding or special treatment.

SUMMARY OF THE INVENTION

The present invention is a masonry unit, masonry system and method of constructing a structure using the system. In its most basic form, the masonry unit of the present invention includes substantially parallel top and bottom surfaces, substantially parallel a front and back surfaces, and substantially parallel right and left surfaces. A locking ridge is disposed upon the top surface and extends along the top surface in substantially parallel relation to the front and back surfaces. A locking channel is disposed within the bottom surface and is dimensioned to mate with locking ridge on the top surface of an adjoining masonry unit. The locking channel is disposed inward from the bottom surface a distance that is a slightly larger than the distance from the top surface to the top of the ridge.

The preferred masonry unit has a web that is made up of at least two, and preferably five, central openings. These central openings are disposed in substantially perpendicular relation between said top surface and said bottom surface and extend through the masonry unit. The preferred masonry unit also includes two end openings that are disposed within said right surface and said left surface and likewise extend through the masonry unit in perpendicular relation with the top and bottom surface. The central and end openings allow the masonry unit to be significantly lighter in weight, easier to carry, and readily adapted for insulation. In addition, the preferred masonry unit is formed from a material comprising concrete and a lightweight aggregate material, which adds to the units' weight and insulation advantages.

The preferred masonry unit is dimensioned to correspond to a standard 12×8×16 inch sized block. Accordingly, the top and bottom surfaces form a rectangle having a length of about sixteen inches and a width of about twelve inches, the front and back surfaces of the preferred masonry unit form a rectangle having a length of about sixteen inches and a width of about eight inches, and the left and said right surfaces form a rectangle having a length of about twelve inches and a width of about eight inches.

In the preferred masonry unit, the locking ridge and locking channel are each disposed substantially along the centerline of the top surface and bottom surface respectively. The preferred locking ridge extends from the top surface a distance of about ½ inch and has a width of about 3⅝ inches, while the preferred locking channel extends into the bottom surface a distance of about ⅝ inch and has a width of about 3¾ inches.

In its most basic form, the masonry system for forming a structure, includes a plurality of primary masonry units of the present invention and a plurality of right and left corner masonry units. The right and left corner masonry units are mirror images of each other and are dimensioned for use at opposite ends of a structure. Each corner masonry unit includes a bottom, a top disposed in substantially parallel relationship to the bottom, an outer side, an inner side disposed in substantially parallel relationship to the inner side, a first end, a second end disposed in substantially parallel relationship to the first end, and a corner block portion extending outward from the inner side and forming a part of the first end. Each of the corner units also includes a locking ridge disposed across at least a portion of the top surface in substantially perpendicular relation to the outer side and the inner side, and a locking channel disposed across at least a portion of the top surface in substantially perpendicular relation to the outer side and the inner side. The locking ridge is dimensioned and positioned upon the top surface so as to mate with the locking ridge of the primary masonry units disposed above each of the plurality of right corner masonry units, and the locking channel is dimensioned and positioned upon the bottom surface so as to mate with the locking ridge of each of the plurality of primary masonry units disposed below each of the plurality of right corner units.

The masonry system is adapted to form a structure having an outer surface and an inner surface by stacking alternating courses of primary masonry units and right corner masonry units and courses of primary masonry units and left corner masonry units such that the locking ridges and locking channels of the primary masonry units and the right corner masonry units of one course mate with locking channels and locking ridges of primary masonry units and a left corner masonry units of adjacent courses.

In the preferred masonry system a skin of fiberglass and cementicious material is disposed upon the outer surface of the structure formed by the masonry system. The preferred system uses corner masonry units having corner block portions that extend outward from the inner side of the right corner block and the left corner a distance sufficient to allow the length of the first end to be substantially equal to a distance between the front surface and the back surface of the primary masonry unit.

Some embodiments of the system also include end masonry units the end masonry units are similar in all respects to the primary masonry units except that the locking ridge and locking channel do not extend fully to the end of the unit such that an intersection between the locking ridge and the channel is not visible when viewing the end masonry unit from the first end. In these embodiments, the masonry system is adapted to form a structure having an outer surface and an inner surface by stacking alternating courses of end masonry units, primary masonry units and right corner masonry units with courses of end masonry units, primary masonry units and left corner masonry units such that the locking ridges and locking channels of the end masonry units, the primary masonry units and the right corner masonry units of one course mate with locking channels and locking ridges of end masonry units, primary masonry units and, left corner masonry units of adjacent courses.

In the preferred masonry system, each of the primary masonry units, the right corner masonry units and the left corner masonry units further comprises at least two central openings disposed in substantially perpendicular relation between each top surface and the bottom surface, with the primary masonry units preferably having five central openings.

In its most basic form, the method of the present invention includes the steps of: obtaining a plurality of primary masonry units, right corner masonry units and left corner masonry units. Each of the plurality of primary masonry units, right corner masonry units and left corner masonry units have a first end, a second end, a top surface, and a bottom surface, and each having a locking ridge extending in substantially perpendicular relation to the first end in the second end along at least a portion of the top surface, and a locking channel extending in substantially perpendicular relation to the first end and the second end along at least a portion of the bottom surface. Once these specific materials are obtainined the next step involves stacking a base course including one of the right corner masonry unit and the left corner masonry unit and a plurality of primary masonry units. This stacking step includes disposing the first end of one primary masonry unit such that it abuts a second end of an adjacent primary masonry unit and such that the locking ridge and locking channel of one primary masonry unit is aligned with the locking ridge and locking channel of an adjacent primary masonry unit. Once the base course is stacked, the next step is to stack a second course comprising another of the right corner masonry unit and the left corner masonry unit and a plurality of primary masonry units. This stacking step involves disposing the first end of one primary masonry unit such that it abuts a second end of an adjacent primary masonry unit and such that the locking ridge and locking channel of one primary masonry unit is aligned with the locking ridge and locking channel of an adjacent primary masonry unit, and such that each of the locking channels of the second course mate with locking ridges of primary masonry units of the first course. Additional courses are then stacked in alternating relation to form the structure.

In some embodiments of the method a skin of fiberglass and cementicious material is applied to at least one of an outer wall and an inner wall of the structure. In others, the primary masonry units include at least one opening therethrough and the method further involves the steps of disposing insulation within the at least one opening of each of the plurality of primary masonry units.

Therefore, it is an aspect of the present invention to provide a masonry unit and system that allow structures to be dry stacked without mortar.

It is a further aspect of the present invention to provide a masonry unit and system that does not require the use of separate stabilizers or other means for preventing deflection of the structure formed thereby.

It is a further aspect of the present invention to provide a masonry unit and system that allows masonry units to be quickly and accurately aligned during stacking.

It is a further aspect of the present invention to provide a masonry unit and system that produces substantially straight and stable walls.

It is a further aspect of the present invention to provide a masonry unit and system that retards the flow of air from one face of the wall to the other.

It is a further aspect of the present invention to provide a masonry unit and system that may be manufactured of a mixture of concrete and lightweight aggregate.

It is a further aspect of the present invention to provide a masonry unit and system that may be easily insulated or reinforced after the structure has been built.

It is a further aspect of the present invention to provide a masonry unit and system that will readily accept plaster or mesh substrates upon its outside surfaces without the need for sanding or special treatment.

These aspects of the invention are not meant to be exclusive and other features, aspects, and advantages of the present invention will be readily apparent to those of ordinary skill in the art when read in conjunction with the following description, and accompanying drawings.

DETAILED DESCRIPTION OF THE INVENTION

Figure 1:
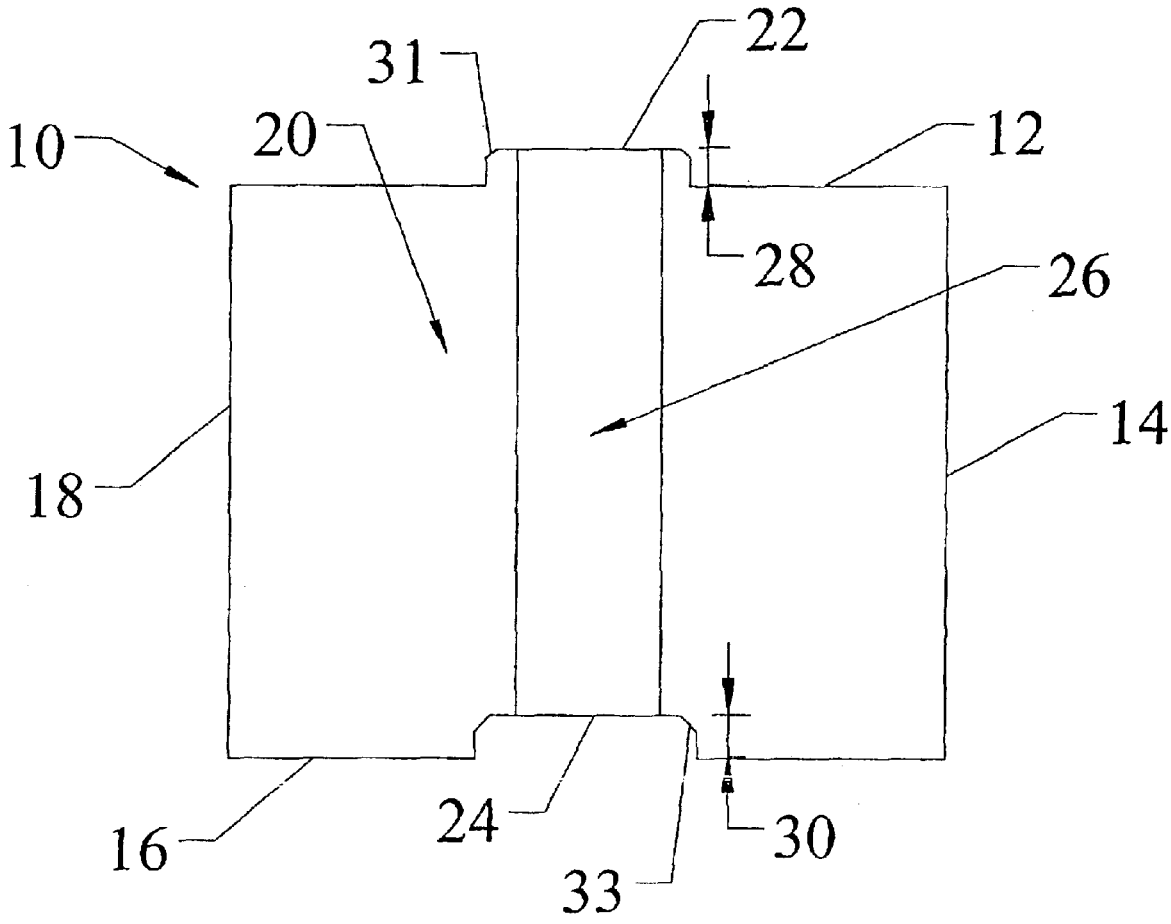
FIG. 1 is a side view of the preferred masonry unit of the present invention.
Figure 2:
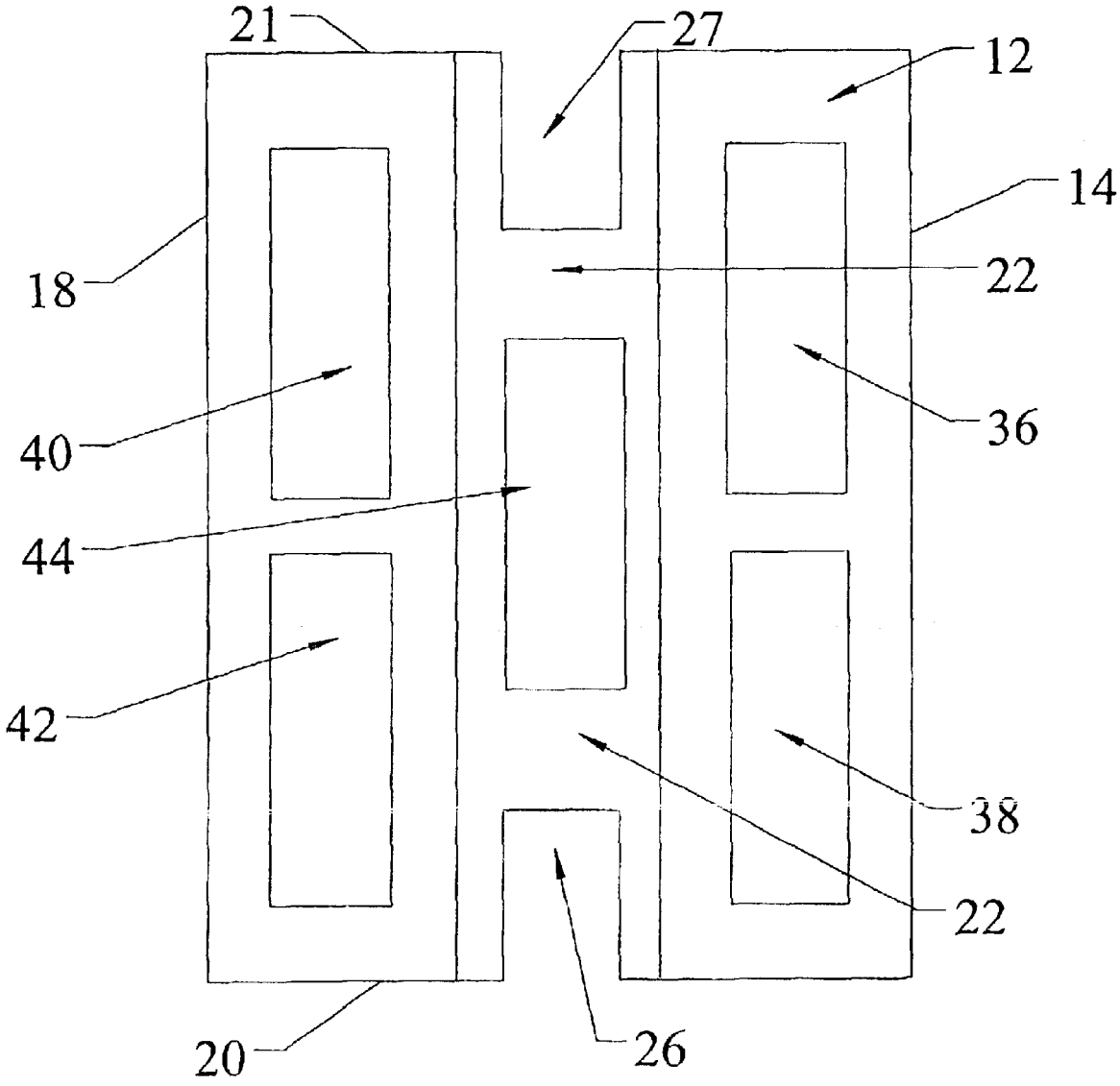
FIG. 2 is a top view of the preferred masonry unit of FIG. 1.
Figure 3:
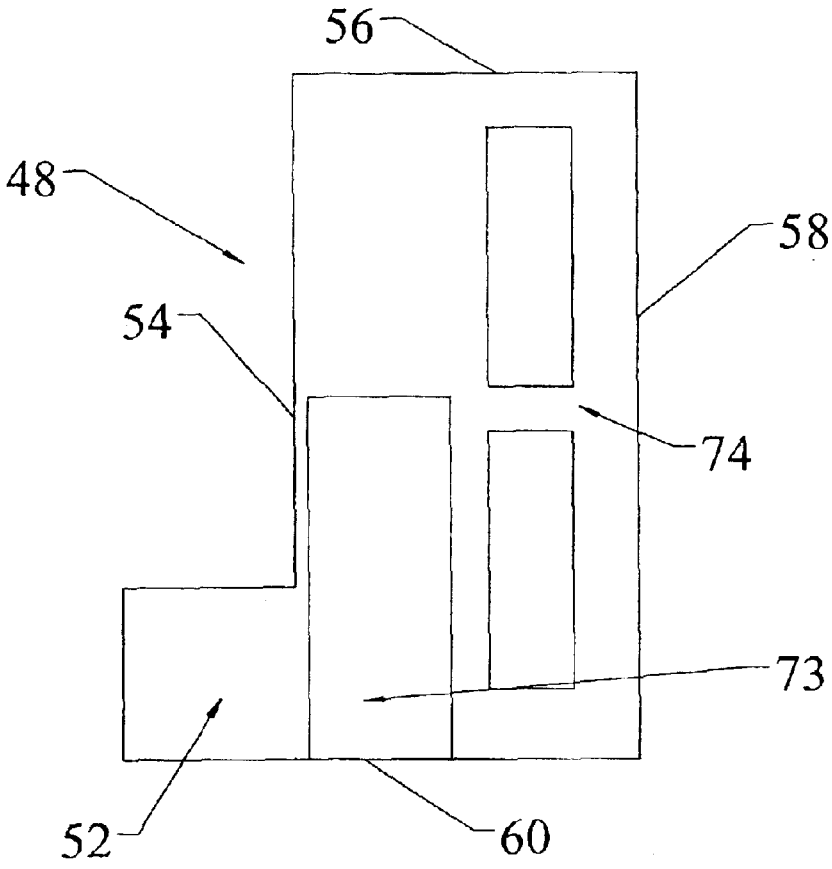
FIG. 3 is a bottom view of the preferred left corner masonry unit of the system of the present invention.
Figure 4:
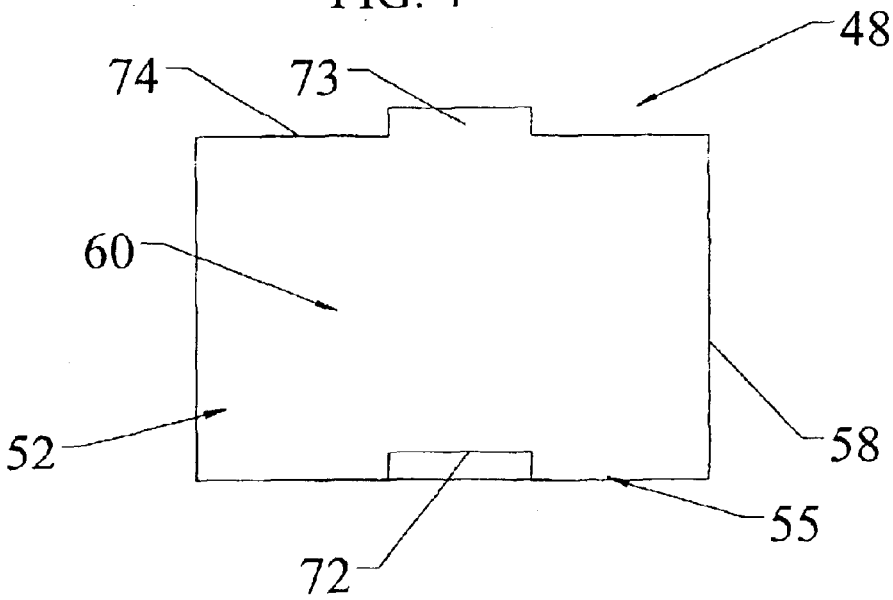
FIG. 4 is a left side view of the preferred left corner masonry unit of FIG. 3.
Figure 5:
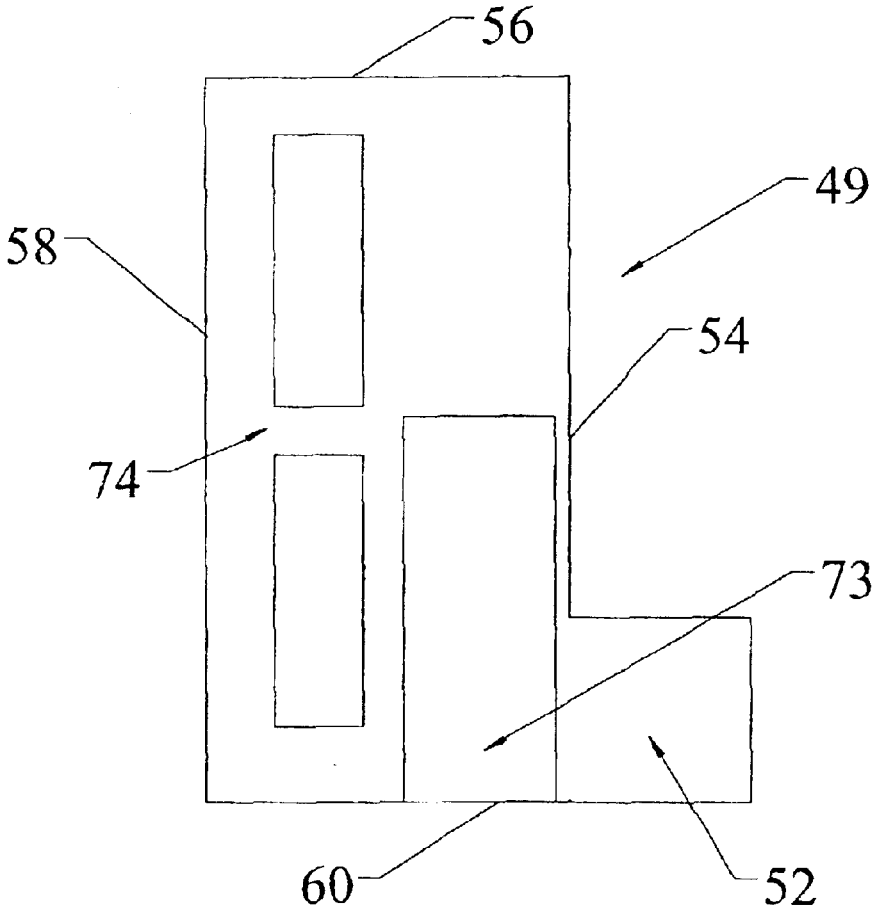
FIG. 5 is a bottom view of the preferred right corner masonry unit of the system of the present invention.
Figure 6:
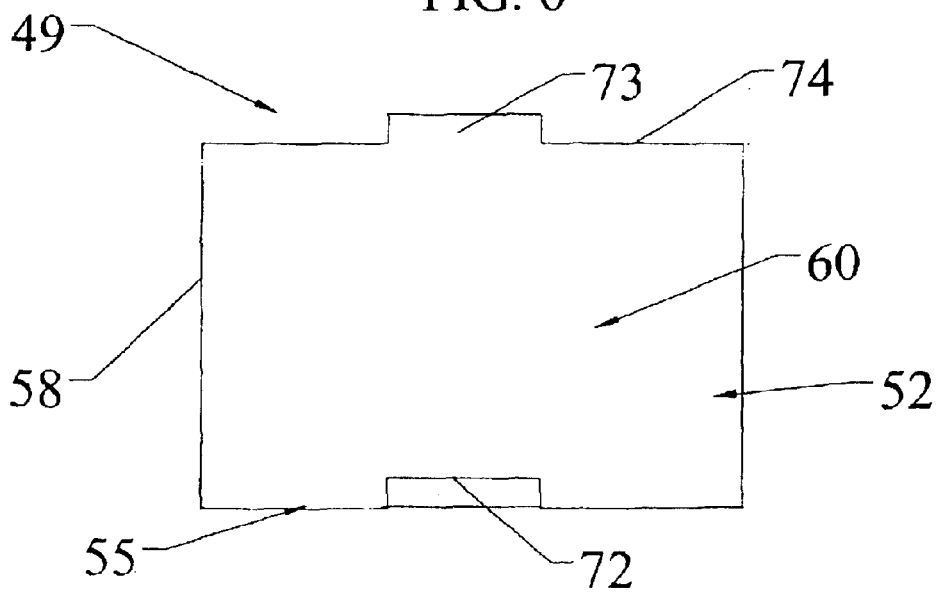
FIG. 6 is a right side view of the preferred right corner masonry unit of FIG. 5.

Referring first to FIGS. 1 and 2, the preferred masonry unit 10 of the present invention is shown. The preferred masonry unit 10 is formed to substantially resemble a standard twelve inch by eight inch by sixteen inch masonry unit, and includes a top surface 12, a bottom surface 16, a front surface 14, a back surface 18, a left surface 20 and a right surface 21. In these embodiments, the top and bottom surfaces 12, 16 form a rectangle having a length of about sixteen inches and a width of about twelve inches, the front and back surfaces 14, 18 form a rectangle having a length of about sixteen inches and a width of about eight inches, and the left and right surfaces 2, 21 form a rectangle having a length of about twelve inches and a width of about eight inches. However, it is understood that embodiments of the masonry unit 10 having different dimensions may be utilized to achieve similar results. For example, eight inch by inch by eight inch by sixteen inch masonry units may be utilized in a similar manner and are contemplated by the present invention.

A locking ridge 22 is disposed upon the top surface 12 and, in the preferred embodiment, is a unitary ridge that extends along the entire top surface 12 in substantially parallel relation to the front and back surfaces 14, 18. However, it is recognized that, in other embodiments, the locking ridge 22 may be broken into two or more sections, with each running in parallel relation to the front and back surfaces 14, 18. The preferred locking ridge 22 is substantially rectangular in cross section and extends upward a first distance 28 of approximately one half inch from top surface 12 and across a width of approximately 3⅝ inches. The edges 31 of the locking ridge 22 are preferably chamfered to aid in positioning of the unit 10 and to prevent chipping of the edges 31 during installation. However, in other embodiments the edges 31 are substantially perpendicular, rounded, or are formed with other art recognized profiles that will allow the ridge to mate with the locking channel 24.

The locking channel 24 is disposed with in the bottom surface 16 and is dimensioned to mate with locking ridge 22 on the top surface 12 of an adjoining masonry unit 10. In the preferred masonry unit, the locking ridge 22 and locking channel 24 are each disposed substantially along the centerline of the top surface 12 and bottom surface 16 respectively, as this allows the unit to be laid without regard to the orientation of the front surface 14 and back surface 18. However, it is recognized that the ridge 22 and channel 24 could be slightly offset from the centerline in either direction, in which case the units 10 would be unidirectional.

The locking channel 24 is preferably disposed inward from the bottom surface 16 a second distance 30 that is a slightly larger than the first distance 28 from the top surface 12 to the top of the ridge 22. Accordingly, the preferred unit has a second distance of approximately ⅝ of an inch and a width of approximately 3¾ inches. This is preferred as it insures that the bottom surface 16 of one unit 10 will bear upon the top surface 12 of a unit on an adjoining course of a structure (not shown). However, in other embodiments, the second distance 30 is substantially equal to the first distance 28 and the weight of the structure is distributed across both the top and bottom surfaces 12, 16 and the interface between the locking ridge 20 and locking channel 22.

The locking ridge 22 and locking channel 24 impart lateral stability to the structure built using the units 10 and insure that the front and read surfaces 14, 18 of each unit 10 are set and remain parallel with one another when stacked. Accordingly, the locking ridge 22 and locking channel 24 in the masonry unit 10 of the present invention allow the units 10 to be dry stacked, without mortar, and without the need for the use of lateral reinforcements necessary in other art recognized masonry systems. Further, the locking ridge 22 and locking channel 24 create an airflow barrier that causes air to have to flow around the ridge and channel 24 to enter the interior of the structure. This significantly enhances the insulation value of the wall by making it much more difficult for cold or warm air to enter the structure and makes it possible to erect an energy efficient structure without the use of a skin, if so desired.

The preferred masonry unit 10 has a web that is made up of at least two, and preferably five, central openings 36, 38, 40, 42, 44. These central openings 36, 38, 40, 42, 44 are disposed in substantially perpendicular relation between said top surface 12 and said bottom surface 16 and extend through the masonry unit 10 to form voids therein. It is preferred that the central openings 36, 38, 40, 42, 44 be of substantially equal size, run parallel to one another, and be staggered in a repeating offset pattern, such as the pattern shown in FIG. 2. In order to maintain this offset pattern, the preferred masonry unit 10 also includes two end openings 26, 27 disposed within the right left surfaces 21, 20. Each of these end openings likewise 26, 27 extend through the masonry unit 10 in perpendicular relation with the top and bottom surface 12, 16 and are each preferably sized to allow an opening having the same size as the central openings 36, 38, 40, 42, 44 to be formed by end openings 26, 27 of adjoining units 10 when stacked next to one another. Finally, as discussed further below in connection with FIGS. 7 and 8, the central openings 36, 38, 40, 42, 44 and end openings 26, 27 are preferably dimensioned and disposed in positions that allow the openings of one unit to align with openings of mating blocks in adjoining courses to form substantially unobstructed bores from a top course of a structure (not shown), all the way to the bottom course of the structure. This allows the structure to be reinforced, if such reinforcement is desired, or is required by local building codes.

The central openings 36, 38, 40, 42, 44 and end openings 26, 27 provide the preferred masonry unit 10 of the present invention with significant advantages. First, they allow the unit 10 to be significantly lighter in weight than a solid masonry unit 10 of identical exterior dimension. Second, they provide a handhold in the unit 10, making the unit 10 much easier to carry and set. Finally, and most importantly, the combination of the elimination of lateral reinforcements and alignment of the openings allow the walls formed by the units 10 to be readily adapted for insulation, or reinforcement, as the bores formed by the openings may be filled with foam, granulated insulation such as pearlite, concrete, steel rebar or other art recognized fillers.

The preferred masonry unit 10 is formed from a mixture of cement, water, and pumice or solilite, which is used to reduce the weight of the unit and add to its insulating properties. However, it is recognized that similar units maybe manufactured of other materials commonly utilized it the manufacture of masonry products to achieve similar results. Further, it is preferred that the material used in the manufacture of the masonry units 10 produce a substantially rough surface as such surface will easily accept skins and or other wall treatments, such a plaster, directly thereto.

Figure 7:
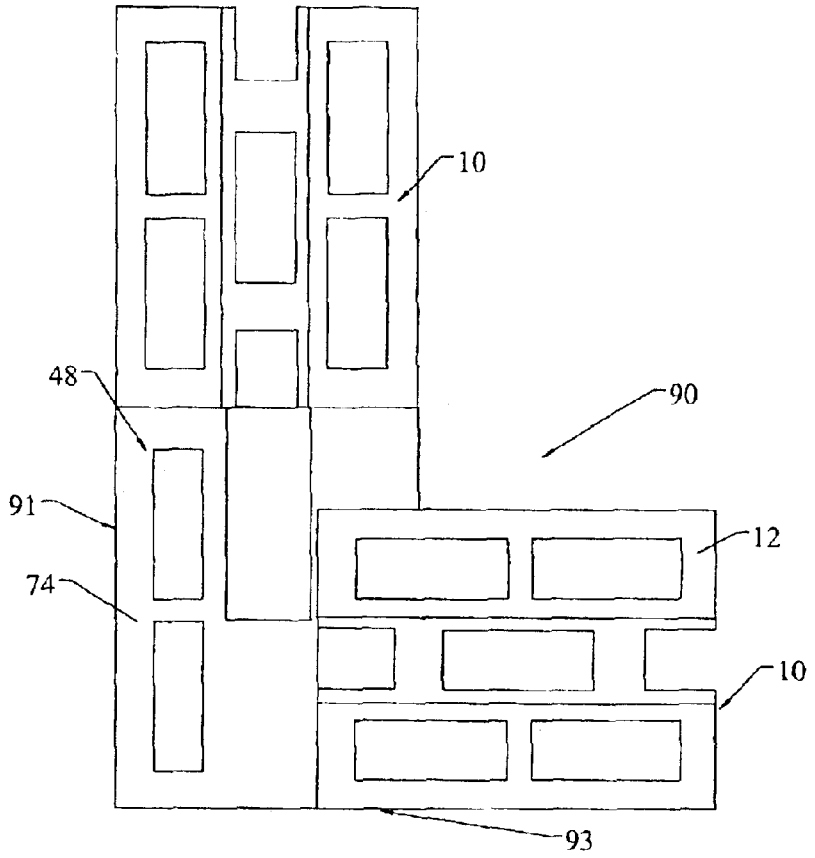
FIG. 7 is a partial top view of a first course of a structure manufactured using the preferred masonry system showing two primary masonry units and a right corner masonry unit used to form a corner.
Figure 8:
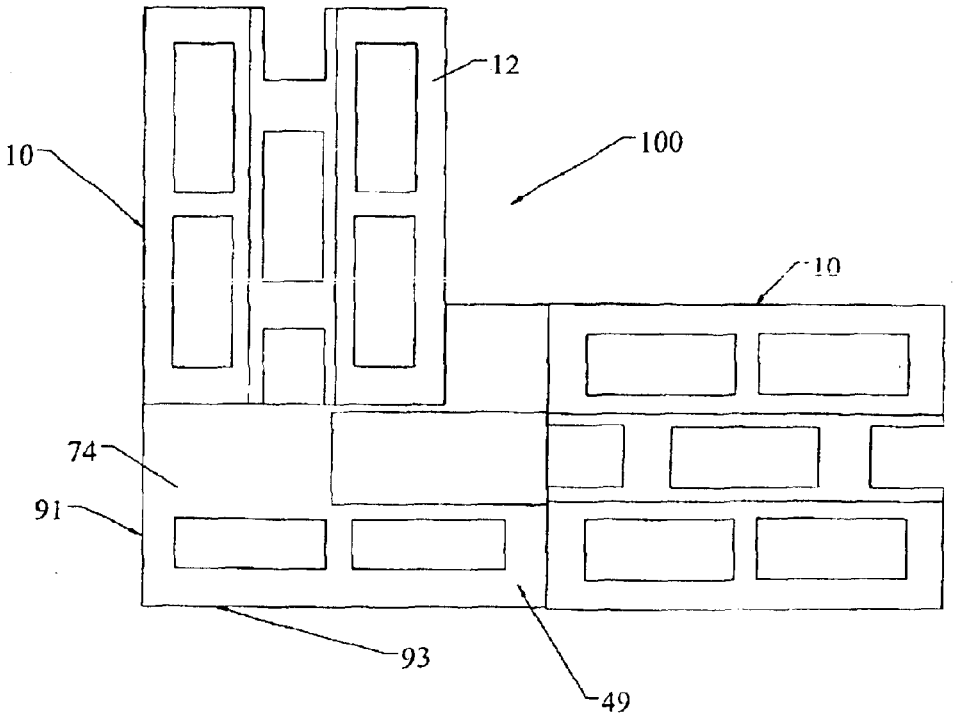
FIG. 8 is a partial top view of a second course of the structure of FIG. 7 showing two primary masonry units and a left corner masonry unit that are stacked upon the first course.

Referring now to FIGS. 3–6, the system of the present invention utilizes a right corner unit 48 and a left corner unit 49. These corner units 48, 49 are mirror images of one another and act to secure the right and lefts ends of the structure, or are stacked in alternating relation, as shown in FIGS. 7 & 8, to form a single corner. The corner units 48, 49 each include a bottom 55, a top 74, an outer side 58, an inner side 54, a first end 60 and a second end 56. A corner block portion 52 extends outward from the inner side 54 of the corner unit 48 and forms part of the first end 60 and the corner unit 48. The corner block portion 52 is preferably a rectangular polygon that extends outward from the inner side 54 of the unit 48, 49 a distance sufficient to allow the length of the first end 60 to be substantially equal to the width of the primary masonry unit (not shown). This is preferred as it allows all courses to be fully supported at the corners, and produces an unbroken interior surface that may be readily plastered or reinforced with a skin. However, as the corner block portion 52 will be hidden within the body of the structure, other embodiments of the corner block portion 52 may extend greater or lesser lengths to achieve similar results.

The corner units 48, 49 also includes a locking channel 72 that is disposed upon its bottom surface 55 and a locking ridge 73 that is disposed upon its top surface 74. The locking channel 72 is dimensioned and positioned upon the bottom surface 55 such that it will mate with the locking ridge of the primary masonry unit disposed below the corner unit 48, 49 when stacked. Similarly, the locking ridge 73 is dimensioned and positioned upon the top surface 74 such that it will mate with the locking ridge of the primary masonry unit disposed above the corner unit 48, 49 when stacked.

Figure 9:
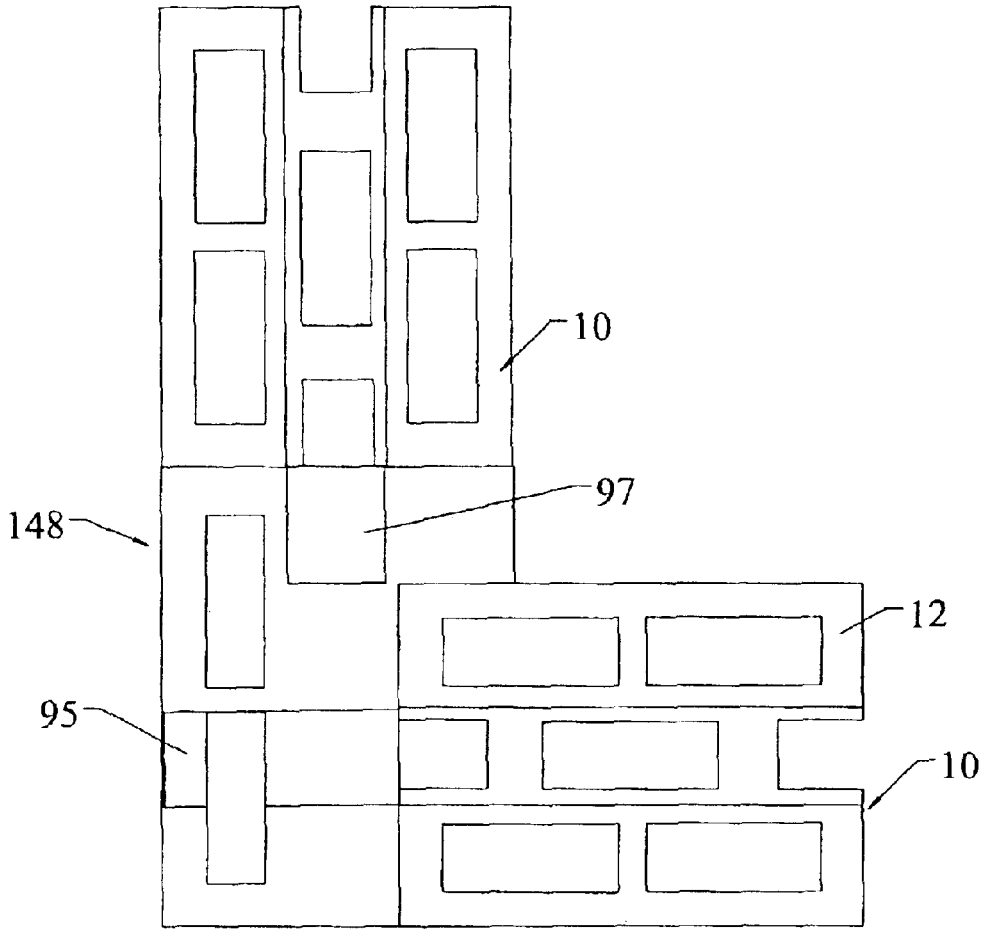
FIG. 9 is a partial top view of a first course of a structure manufactured using an alternative embodiment of the masonry system showing two primary masonry units and a special right corner masonry unit used to form a corner.
Figure 10:
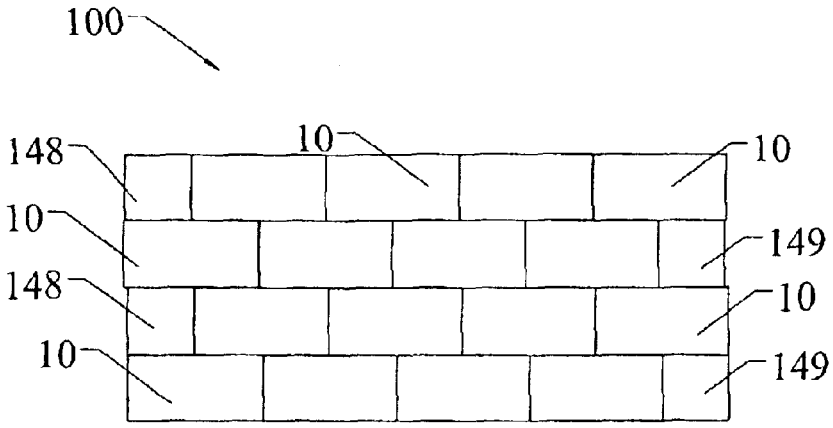
FIG. 10 is an end view of a structure formed by the embodiment of the masonry system shown in FIG. 9.

In the preferred embodiments of the masonry system of the present invention, the locking ridge 73 and locking channel 72 of the corner units 48, 49 extend only partially from the inner side 54 and across the top surface 74 and bottom surface 55 of the units 48, 49 in order to mate with the ridges and channels of the primary masonry units when stacked in the manner shown in FIGS. 7 & 8, or with the end masonry units when stacked in the manner shown in FIG. 10. This allows the channels and ridges that would normally be exposed at the corners of the structure to be hidden, giving the structure a consistent and unbroken appearance. However, as shown in FIG. 9, in other embodiments of the system, such as those in which a skin is applied to the outer surfaces of the structure, only primary masonry units 10, right corner units 48 and left corner units 49 are utilized, and the locking ridges 73 and locking channels 72 of the corner masonry units 48, 49 extend fully such that the joints formed with the mating primary masonry units 10 are visible.

Referring now to FIGS. 7 & 8, the preferred embodiment of the system of the present invention is described. The preferred embodiment is stacked in a manner similar to that of conventional and structures. The first course 90 includes a right corner unit 48 that is disposed such that the long side faces the left surface 91 of the structure. The second course 100 includes a left corner unit 49 that is disposed such that the long side faces the front surface 93 of the structure. When stacked together in this manner, the corner units 48, 49 are alternated such that the ridges 73 and channels 72 of each corner mate with ridges 22 and channels 24 of the primary masonry units of adjacent courses. By using the preferred corner units 48, 49 in this manner, none of the ridge and channel joints are visible on the outer surface of the corner of the structure, proving the same appearance as traditional masonry walls. In addition, the provision of the truncated ridges 73 and channels 72 insures that the corners of the structure are stacked properly, as improper positioning would result in the ridges and channels not mating with one another.

As shown in FIGS. 9 & 10, some embodiments of the system are stacked in a different manner, with special right corner units 148 and left corner units 149, being utilized at the right end left corners of alternating courses and the primary masonry units 10 forming the remainder of the courses, as shown in FIG. 10. In these embodiments, the special corner units 148, 149 each have a second and ridge 95 and channel (not shown) disposed in perpendicular relation to the first ridge 97 and channel (not shown) and aligned to mate with the channels and ridges of the primary masonry units 10 of adjacent courses. The joints between the locking channels and locking ridges of the primary masonry units 10 and corner masonry units 148, 149 are exposed in these embodiments. Accordingly, it is preferred that these systems include a conventional skin of fiberglass and cementicious material disposed at least upon the outside walls in order to hide these joints.

Figure 11:
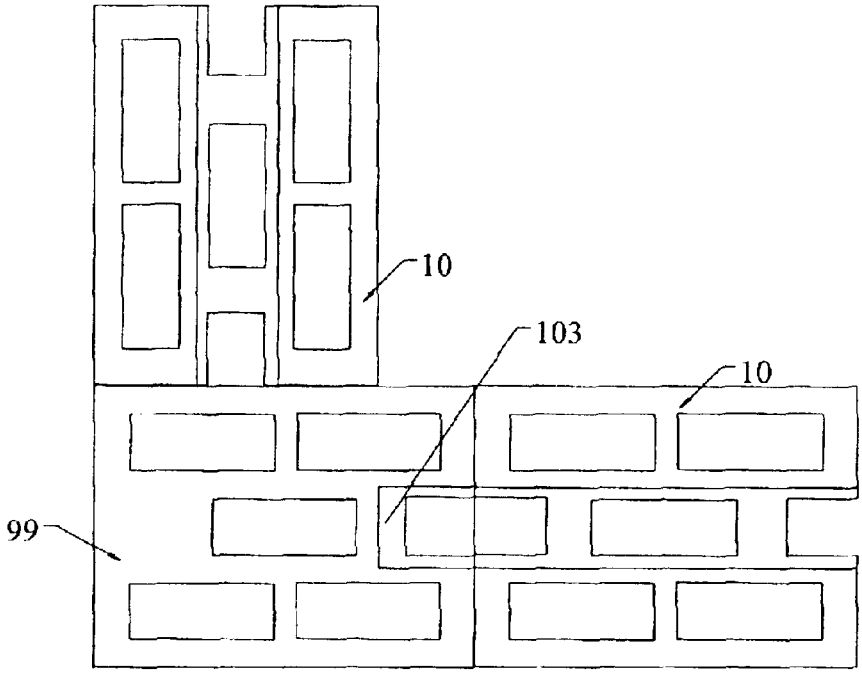
FIG. 11 is a partial top view of a first course of a structure manufactured using still another embodiment of the masonry system showing two primary masonry units and an end masonry unit used to form a corner.
Figure 12:
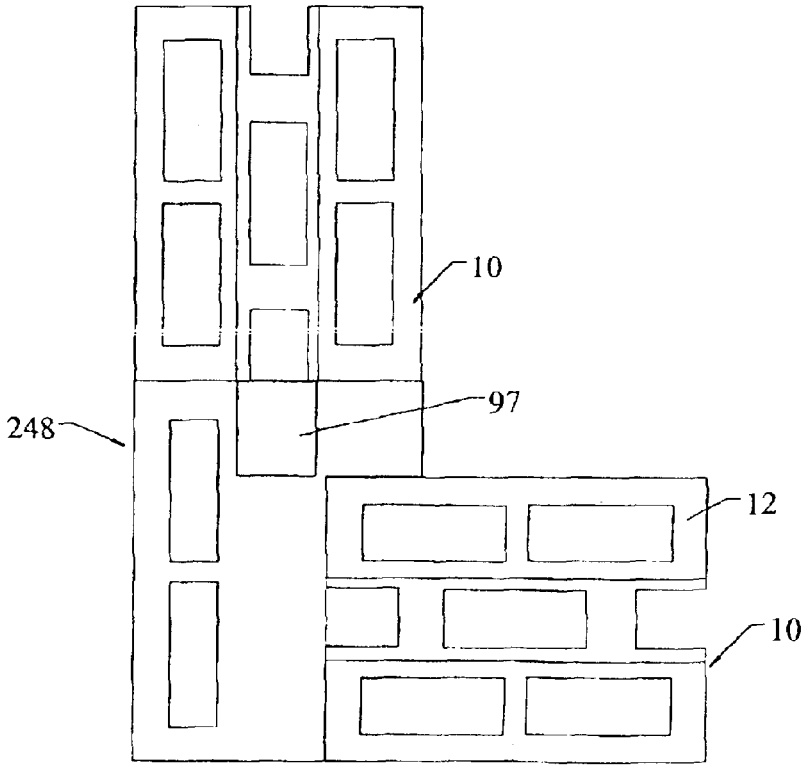
FIG. 12 is a partial top view of a second course of the structure of FIG. 11 showing two primary masonry units and another embodiment of a right corner masonry unit that are stacked upon the first course.
Figure 13:
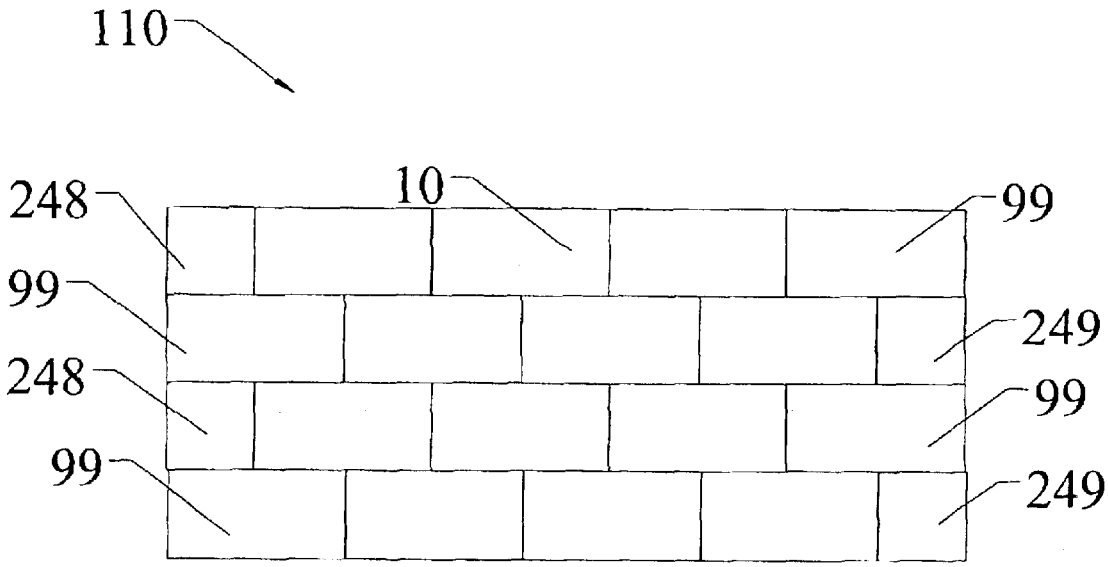
FIG. 13 is an end view of a structure formed by the masonry system of FIGS. 11 & 12.

As shown in FIGS. 11–13, other embodiments of the system uses end masonry units 99, which mate with still other right and left corner units 248, 249 at the ends of the structure. As noted above, the end masonry units 99 include truncated locking ridges and locking channels, which mate with the ends of the locking ridges and locking channels of the primary masonry units 10 of adjoining courses. Similarly, the corner units 248, 249 include only one truncated ridge 97 and channel (not shown) to mate with the ends of locking ridges and locking channels of the primary masonry units 10 of adjoining courses. By truncating the ridges and channels, none of the ridge and channel joints are visible on the outer surface of the structure, proving the same appearance as traditional masonry walls and those of the preferred embodiment.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A masonry unit comprising:

a top surface;

a bottom surface disposed in substantially parallel relationship to said top surface;

a front surface;

a back surface disposed in substantially parallel relation to said front surface and in substantially perpendicular relation to said top surface and said bottom surface;

a right surface; and a left surface disposed in substantially parallel relation to said right surface and in substantially perpendicular relation to said top surface, said bottom surface, said front surface and said back surface;

at least two end openings, said end openings being disposed within said right surface and said left surface in substantially perpendicular relation between said top surface and said bottom surface; and a locking ridge substantially centrally disposed upon said top surface; and extending upward a first distance therefrom, said locking ridge being disposed in substantially perpendicular relation to said right surface and said left surface and in substantially parallel relation to said front surface and said back surface;

wherein said bottom surface comprises a substantially centrally disposed locking channel extending upward a second distance therefrom, said locking channel being dimensioned to mate with said locking ridge of said top surface.

2. The masonry unit as claimed in claim 1 comprising five central openings, wherein two central openings are disposed between said locking ridge of said top surface and said front surface, wherein two central openings are disposed between said locking ridge of said top surface and said back surface, and wherein one central opening is disposed in substantially perpendicular relation between said locking ridge said top surface and said locking channel in said bottom surface.

3. The masonry unit as claimed in claim 1;

wherein said top surface and said bottom surface are each dimensioned to form a rectangle having a length of about sixteen inches and a width of about twelve inches;

wherein said front surface and said back surface are each dimension to form a rectangle having a length of about sixteen inches and a width of about eight inches; and wherein said left surface and said right surface are each dimensioned to form a rectangle having a length of about twelve inches and a width of about eight inches.

4. The masonry unit as claimed in claim 3 wherein said locking ridge extends a first distance from said top surface of about ½ inch and has a width of about 3⅝ inches; and wherein said locking channel extends a second distance of about ⅝ inch and has a width of about 3¾ inches.

5. A masonry system for forming a structure, said system comprising:

a plurality of primary masonry units, wherein each of said plurality a primary masonry units comprises:

a top surface, a bottom surface disposed in substantially parallel relationship to said top surface, a front surface, a back surface disposed in substantially parallel relation to said front surface and in substantially perpendicular relation to said top surface and said bottom surface, a right surface, and a left surface disposed in substantially parallel relation to said right surface and in substantially perpendicular relation to said top surface, said bottom surface, said front surface an said back surface;

a locking ridge disposed upon said top surface, and extending upward a first distance therefrom, said locking ridge being disposed in substantially perpendicular relation to said right surface and said left surface and in substantially parallel relation to said front surface and said back surface; and wherein said bottom surface comprises a locking channel extending upward a second distance therefrom, said channel being dimensioned to mate with said locking ridge of said top surface;

a plurality of right corner masonry units, wherein each of said plurality of right corner masonry units comprises:

a bottom, a top disposed in substantially parallel relationship to said bottom, an outer side, an inner side disposed in substantially parallel relationship to said inner side, a first end, a second end disposed in substantially parallel relationship to said first end, and a corner block portion extending outward from said inner side and forming a part of said first end;

wherein each of said plurality of right corner masonry units further comprises a locking ridge disposed across at least a portion of said top surface in substantially perpendicular relation to said outer side and said inner side, and a locking channel disposed across at least a portion of said top surface in substantially perpendicular relation to said outer side and said inner side; and wherein said locking ridge is dimensioned and positioned upon said top surface so as to mate with said locking ridge of the primary masonry units disposed above each of said plurality of right corner masonry units, and wherein said locking channel is dimensioned and positioned upon said bottom surface so to mate with said locking ridge of each of said plurality of primary masonry units disposed below each of said plurality of right corner units; and a plurality of left corner masonry units, wherein each of said plurality of right corner masonry units comprises:

a bottom, a top disposed in substantially parallel relationship to said bottom, an outer side, an inner side disposed in substantially parallel relationship to said inner side, a first end, a second end disposed in substantially parallel relationship to said first end, and a corner block portion extending outward from said inner side and forming a part of said first end;

wherein each of said plurality of said left corner masonry units further comprises a locking ridge disposed across at least a portion of said to surface in substantially perpendicular relation to said outer side and said inner side, and a locking channel disposed across at least a portion of said top surface in substantially perpendicular relation to said outer side and said inner side; and wherein said locking ridge is dimensioned and positioned upon said top surface so as to mate with said locking ridge of each of said plurality of primary masonry units disposed above each of said plurality of left corner masonry units, and wherein said locking channel is dimensioned and positioned upon said bottom surface so as to mate with said locking ridge of each of said plurality of primary masonry units disposed below each of said plurality of left corner masonry unit;

wherein said masonry system is adapted to form a structure having an outer surface and an inner surface by stacking alternating courses of primary masonry units and right corner masonry units and courses of primary masonry units and left corner masonry units such that said locking ridges and locking channels of said primary masonry units and said right corner masonry units of one course mate with locking channels and locking ridges of primary masonry units and a left corner masonry units of adjacent courses.

6. The masonry system as claimed in claim 5 further comprising a skin of fiberglass and cementicious material disposed upon said outer surface of said structure formed by said masonry system.

7. The masonry system as claimed in claim 5 wherein said corner block portion of said right corner block and said corner block portion of said left corner block each extend outward from said inner side of said right corner block and said left corner a distance sufficient to allow the length of said first end to be substantially equal to a distance between said front surface and said back surface of said primary masonry unit.

8. The masonry system as claimed in claim 5 further comprising a plurality of end masonry units, wherein each of said end masonry units comprises:

a top surface, a bottom surface disposed in substantially parallel relationship to said top surface, a front surface, a back surface disposed in substantially parallel relation to said front surface and in substantially perpendicular relation to said top surface and said bottom surface, a right surface, and a left surface disposed in substantially parallel relation to said right surface and in substantially perpendicular relation to said top surface, said bottom surface, said front surface and said back surface;

a locking ridge disposed upon a portion of said top surface, said locking ridge extending upward a first distance from said portion of said top surface in substantially perpendicular relation to said right surface and said left surface and in substantially parallel relation to said front surface and said back surface, and wherein said bottom surface comprises a locking channel extending upward a second distance into a portion of said bottom surface, said locking channel being dimensioned and positioned to mate with said locking ridge of said top surface;

wherein said locking ridge and said locking channel do not extend to said first end such that an intersection between said locking ridge and said channel is not visible when viewing said end masonry unit from said first end; and wherein said masonry system is adapted to form a structure having an outer surface and an inner surface by stacking alternating courses of end masonry units, primary masonry units and right corner masonry units with courses of end masonry units, primary masonry units and left corner masonry units such that said locking ridges and locking channels of said end masonry units, said primary masonry units and said right corner masonry units of one course mate with locking channels and locking ridges of end masonry units, primary masonry units and, left corner masonry units of adjacent courses.

9. The masonry system as claimed in claim 5, wherein each of said primary masonry units, said right corner masonry units and said left corner masonry units further comprises at least two central openings disposed in substantially perpendicular relation between each top surface and said bottom surface.

10. The masonry system as claimed in claim 9 wherein said primary masonry unit comprises five central openings, wherein two central openings are disposed between said locking ridge of said top surface and said front surface, wherein two central openings are disposed between said locking ridge of said top surface and said back surface, and wherein one central opening is disposed in substantially perpendicular relation between said locking ridge on said top surface and said locking channel in said bottom surface.

11. The masonry system as claimed in claim 5;

wherein said top surface and said bottom surface of each of said plurality of primary masonry units are each dimensioned to form a rectangle having a length of about sixteen inches and a width of about twelve inches;

wherein said front surface and said back surface of each of said plurality of primary masonry units are each dimensioned to form a rectangle having a length of a about sixteen inches and a width of about eight inches; and wherein said left surface and said right surface of each of said plurality of primary masonry units are each dimensioned to form a rectangle having a length of a about twelve inches and a width of about eight inches.

12. The masonry system as claimed in claim 11 wherein said locking ridge of each of said plurality of primary masonry units, said right corner masonry units and said left corner masonry units extends a first distance from said top surface of about ½ inch and has a width of about 3⅝ inches; and wherein said locking channel extends a second distance of about ⅝ inch and has a width of about 3¾ inches.

13. A method of constructing a structure comprising the steps of:

obtaining a plurality of primary masonry units, right corner masonry units and left corner masonry units, each of said plurality of primary masonry units, right corner masonry units and left corner masonry units having a first end, a second end, a top surface, and a bottom surface, and each having a locking ridge extending in substantially perpendicular relation to said first end in said second end along at least a portion of said top surface, and a locking channel extending in substantially perpendicular relation to said first end and said second end along at least a portion of said bottom surface;

stacking a base course comprising one of said right corner masonry unit and said left corner masonry unit and a plurality of primary masonry units, said stacking step comprising the steps of disposing said first end of one primary masonry unit such that it abuts a second end of an adjacent primary masonry unit and such that said locking ridge and locking channel of one primary masonry unit is aligned with said locking ridge and locking channel of an adjacent primary masonry unit;

stacking a second course comprising another of said right corner masonry unit and said left corner masonry unit and a plurality of primary masonry units, said stacking step comprising the steps of disposing said first end of one primary masonry unit such that it abuts a second end of an adjacent primary masonry unit and such that said locking ridge and locking channel of one primary masonry unit is aligned with said locking ridge and locking channel of an adjacent primary masonry unit, and such that each of said locking channels of said second course mate with locking ridges of primary masonry units of said first course;

stacking additional courses in alternating relation to form said structure.

14. The method as claimed in claim 13 further comprising the step of applying a skin of fiberglass and cementicious material to at least one of an outer wall and an inner wall of said structure.

15. The method as claimed in claim 13 wherein each of said plurality of primary masonry units comprises at least one opening therethrough and wherein said method further comprises the steps of disposing insulation within said at least one opening of each of said plurality of primary masonry units.

* * * * *